US009777717B2

(12) United States Patent
Schmidt

(10) Patent No.: US 9,777,717 B2
(45) Date of Patent: Oct. 3, 2017

(54) DOUBLE ACTING REFRIGERATION COMPRESSOR

(75) Inventor: Werner Schmidt, Chemnitz (DE)

(73) Assignee: Inficon GMBH, Köln (DE)

( * ) Notice: Subject to any disclaimer, the term of this patent is extended or adjusted under 35 U.S.C. 154(b) by 196 days.

(21) Appl. No.: 13/977,823

(22) PCT Filed: Jan. 5, 2012

(86) PCT No.: PCT/EP2012/050150
§ 371 (c)(1),
(2), (4) Date: Jul. 1, 2013

(87) PCT Pub. No.: WO2012/093160
PCT Pub. Date: Jul. 12, 2012

(65) Prior Publication Data

US 2013/0287611 A1 Oct. 31, 2013

(30) Foreign Application Priority Data

Jan. 7, 2011 (DE) ..... 10 2011 008 086

(51) Int. Cl.
*F04B 25/02* (2006.01)
*F04B 53/12* (2006.01)
(Continued)

(52) U.S. Cl.
CPC ..... *F04B 25/02* (2013.01); *F04B 1/02* (2013.01); *F04B 5/00* (2013.01); *F04B 17/04* (2013.01);
(Continued)

(58) Field of Classification Search
CPC ..... F04B 53/148; F04B 53/12; F04B 25/02; F04B 39/0016; F04B 35/045; F04B 25/00;
(Continued)

(56) References Cited

U.S. PATENT DOCUMENTS 184,603 A * 11/1876 Farrar ..... 417/552
1,500,391 A 7/1924 Hutchings
(Continued)

FOREIGN PATENT DOCUMENTS

CN 1067295 A 12/1992
CN 2623901 Y 7/2004
(Continued)

OTHER PUBLICATIONS

European Patent Office, International Search Report for Corresponding International Application No. PCT/EP2012/050150 dated Apr. 5, 2012—German and English Languages (6 pgs).
(Continued)

*Primary Examiner* — Bryan Lettman
(74) *Attorney, Agent, or Firm* — Harris Beach PLLC

(57) ABSTRACT

A double-acting refrigerant compressor includes a piston freely guided on two cylinder portions arranged opposite to each other and being immobile relative to each other. The piston includes a flow channel extending internally through the piston. Each cylinder portion and the piston include, along the flow channel, respectively at least one back-check valve. The back-check valves are arranged in such a manner that their flow directions are unidirectional.

11 Claims, 3 Drawing Sheets

(51) Int. Cl.

| | |
|---|---|
| ***F04B 35/04*** | (2006.01) |
| ***F04B 5/00*** | (2006.01) |
| ***F04B 1/02*** | (2006.01) |
| ***F04B 17/04*** | (2006.01) |
| ***F04B 25/04*** | (2006.01) |
| ***F04B 25/00*** | (2006.01) |
| ***F04B 31/00*** | (2006.01) |
| ***F04B 39/00*** | (2006.01) |
| ***F04B 53/14*** | (2006.01) |

(52) U.S. Cl.
CPC ..... *F04B 17/046* (2013.01); *F04B 25/005* (2013.01); *F04B 25/04* (2013.01); *F04B 31/00* (2013.01); *F04B 35/045* (2013.01); *F04B 39/0016* (2013.01); *F04B 53/12* (2013.01); *F04B 53/122* (2013.01); *F04B 53/148* (2013.01)

(58) Field of Classification Search
CPC ..... F04B 25/005; F04B 25/04; F04B 27/005; F04B 27/02; F04B 53/122; F04B 17/04; F04B 17/046; F04B 17/042; F04B 17/044; F04B 1/02; F04B 5/00; F04B 5/02
See application file for complete search history.

(56) References Cited

U.S. PATENT DOCUMENTS

| | | | | |
|---|---|---|---|---|
| 1,822,242 | A * | 9/1931 | Schongut | F04B 17/046 417/259 |
| 4,051,877 | A | 10/1977 | Fletcher et al. | |
| 4,735,185 | A * | 4/1988 | Imoto | F02B 3/00 123/498 |
| 5,818,131 | A * | 10/1998 | Zhang | B63H 11/08 128/DIG. 3 |
| 7,322,804 | B2 * | 1/2008 | Humburg | F04B 17/046 417/416 |
| 2004/0052651 | A1 | 3/2004 | Beetz et al. | |
| 2006/0034712 | A1 | 2/2006 | Park et al. | |
| 2006/0104844 | A1 | 5/2006 | Antufjew et al. | |
| 2007/0260111 | A1 | 11/2007 | Baur | |
| 2008/0226477 | A1 * | 9/2008 | Wu et al. | 417/417 |

FOREIGN PATENT DOCUMENTS

| | | | |
|---|---|---|---|
| CN | 1952391 | A | 4/2007 |
| CN | 201116519 | Y | 9/2008 |
| DE | 1653447 | B1 | 12/1969 |
| DE | 10125420 | C1 | 10/2002 |
| DE | 10314007 | A1 | 10/2004 |
| DE | 102005038605 | A1 | 3/2006 |
| GB | 421508 | A | 12/1934 |
| JP | S5378407 | A | 7/1978 |
| JP | 2000097152 | A | 4/2000 |
| JP | 2006057634 | A | 3/2006 |
| JP | 2006209675 | A | 8/2006 |
| RU | 2296241 | C1 | 3/2007 |
| SU | 1174590 | A1 | 8/1985 |
| TW | 200844328 | A | 11/2008 |

OTHER PUBLICATIONS

European Patent Office, Written Opinion of the International Searching Authority dated Apr. 5, 2012 for Corresponding International Application No. PCT/EP2012/050150—English and German Languages (11 pgs).

* cited by examiner

DOUBLE ACTING REFRIGERATION COMPRESSOR

CROSS-REFERENCE TO RELATED APPLICATIONS

This application is a national stage application under 35 U.S.C. §371 of PCT Application No. PCT/EP2012/050150, filed Jan. 5, 2012, which claims priority to and the benefit of German Application No. 102011008086.4 filed on Jan. 7, 2011, which are incorporated herein by reference in their entirety.

The present invention relates to a double-acting refrigerant compressor.

In the field of the recycling of refrigerants from cooling systems, particularly from air conditioning systems, a requirement exists for the use of external compressors which, under the conditions prevailing at the site of use of the air conditioning system, are capable to pump off the refrigerant from the cooling system and to transfer it into a corresponding transport container.

For this purpose, the required compressors have to generate a gas pressure in the bottle that is above the steam pressure of the refrigerant at the respective ambient temperatures. In the extreme case, this gas pressure can be distinctly above 30 bar so that the further assumptions will have to be based on a working pressure of maximally 40 bar.

In known recycling devices for transfer of the refrigerant from a refrigeration system into a recycling container, the recycling device is provided with a compressor and with a bypass line shunting the compressor. The compressor line and the bypass line are each provided with valves, wherein, first, the pressurized refrigerant will flow through the bypass line into the recycling container. After completion of the pressure compensation between the recycling container and the refrigeration system, the residual refrigerant will be transferred into the recycling container via the compressor of the recycling device while the bypass line is closed.

It is an object of the invention to provide a refrigerant compressor which is of a simple and inexpensive design and which achieves the high compression performance required for recovery of the refrigerant.

The refrigerant compressor according to the invention is defined by the features indicated in claim 1. Thus, the refrigerant compressor is a double-acting refrigerant compressor comprising a piston which is freely guided on two mutually opposite cylinder portions. The cylinder portions are not movable relative to each other. The piston comprises a flow channel extending through the interior of the piston. Each cylinder portion and the piston are provided, along the flow channel, with at least one back-check valve, with the flow-through direction of said back-check valves being unidirectional.

Said cylinder portions can be provided as components of a one-pieced cylinder or as separate components. It is decisive that the cylinder portions are not movable relative to each other and that the piston is guided in the cylinder portions freely, i.e. without a connection to other component parts such as e.g. piston rods, and in a sealed manner. An internal flow channel extends through the entire piston from one piston end to the opposite piston end. In the region of the flow channel, the piston comprises at least one back-check valve. Also each cylinder portion comprises at least one back-check valve. Preferably, the flow channel is formed along a linear longitudinal axis along which also said back-check valves are arranged. The flow-through directions of the back-check valves are unidirectional, which is to say that, with a refrigerant flowing through the piston in a first flow direction, the back-check valves are open and, with a refrigerant flowing through the piston in a second flow direction opposite to the first flow direction, the back-check valves are closed.

In this manner, it is rendered possible that the refrigerant of a refrigeration system, being under a high pressure of e.g. 40 bar, can be transferred into a recycling container having a low pressure, without entailing the necessity of a separate bypass line. Upon completion of the pressure compensation between the refrigeration system and the recycling container, the piston, during a stroke movement, will suck in the refrigerant from the refrigeration system in the direction of the recycling container via the back-check valve of that cylinder portion which is facing toward the refrigeration system. During the subsequent opposite stroke movement of the piston from the recycling container in the direction of the refrigeration system, the back-check valve of the piston will open, and the refrigerant previously sucked from the refrigeration system will now flow through the piston via the interior flow channel to the opposites side of the piston facing toward the recycling container. Upon renewed reversal of the stroke movement, the back-check valve of the piston will close, and the piston will press the refrigerant through the back-check valve of the cylinder portion facing the recycling container, and in the direction of the recycling container.

The advantage of the refrigerant compressor of the invention resides in obviating the necessity for a separate bypass line for removal of refrigerant from a refrigeration system and into a recycling container until pressure compensation has been reached. The inner flow channel can be realized in a simple manner, e.g. as a bore. By the piston which is freely guided in the respective cylinder portions, no need exists for the use of seals for the connection of outer mechanics to the piston through the cylinder. The only required seals are to be provided in the region of the back-check valves and of the contact areas between the piston and the cylinder portions.

In case of rotationally symmetrical cylinder portions and pistons with back-check valves and with a flow channel on the central longitudinal axis, the refrigerant compressor of the invention can be produced in a particularly simple manner by turning and drilling.

Between the cylinder portions, there is preferably provided such a distance that a region of the piston is freely accessible from the outside for allowing access to the piston and its drive unit without having to fit seals through the cylinder portions.

Advantageously, the piston comprises, between its two end-side compression surfaces, an auxiliary compression surface which together with one of the two cylinder portions forms an auxiliary volume which, during a stroke movement of the piston effected by a driving force, will generate a restoring force acting against the driving force.

It is of particular advantage if at least one of the two cylinder portions is guided as an inverse piston in said piston so that the piston encloses the respective cylinder portions on the outside and is freely accessible from there, e.g. for gaining access to the drive unit. Particularly, both cylinder portions can be guided as inverse pistons in said piston, wherein the two cylinder portions are immobile relative to each other and only the piston will perform a movement.

The piston can be driven in a contactless manner by two solenoids operating in opposite senses, e.g. in the form of a flat-armature drive or a plunger-armature drive. In case of the flat-armature drive, the armature plate advantageously extends through the interspace between the two cylinder portions into the magnetic field generated by the solenoid. Theoretically, in this regard, one of the two solenoids could be replaced by a spring drive. In case of a plunger-armature drive, the piston can be fully inserted as a plunger armature into the interior of a one-pieced cylinder.

Alternatively, an eccentric guide system of a crankshaft drive could be connected to the piston through the interspace between the two cylinder portions, or a rotary drive could—via a nose element—engage an 8-shaped sliding path on the surface of the piston.

Embodiments of the invention will be described in greater detail hereunder with reference to the Figures. In the Figures, the following is shown:

Figure 1:
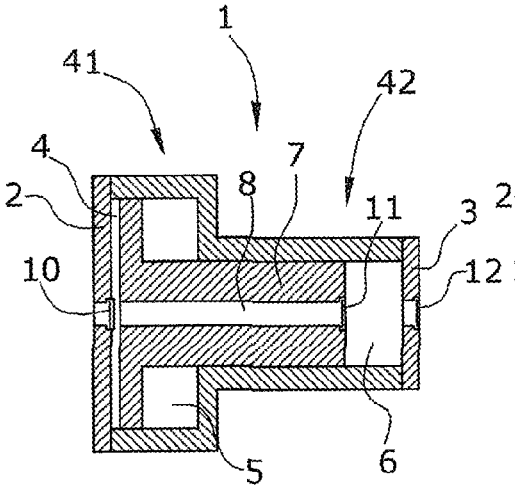
FIG. 1 shows the first embodiment in a first operating state.
Figure 2:
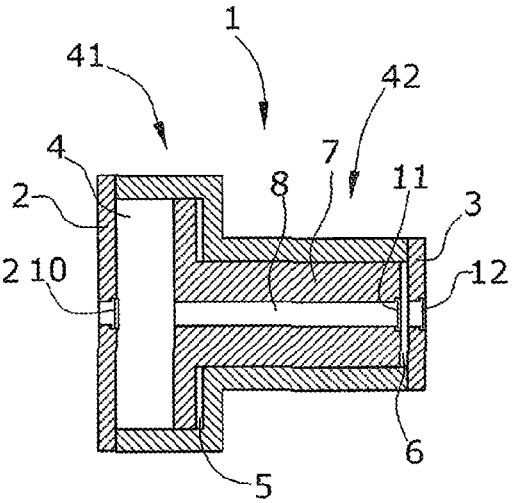
FIG. 2 shows the first embodiment in a second operating state.

In the refrigerant compressor according to the first embodiment shown in FIGS. 1 and 2, the compressor system comprises the stepped cylinder 1 in which the piston 7 with the central overflow channel 8 is guided in axial direction. The cylinder is terminated by the inlet valve plate 2 and the outlet valve plate 3 in which the inlet valve 10 and respectively the outlet valve 12 are inserted. Overflow channel 8 is terminated by a further valve 11 on the side where the outlet is located.

In this arrangement, the larger-diametered left portion of the stepped cylinder 1 forms the first cylinder portion 41, and the smaller-diametered right-hand portion of the stepped cylinder 1 forms the second cylinder portion 42. Thus, the two cylinder portions 41 and 42 are integrally connected and form the cylinder 1.

The basic function of the double-acting inline free-piston compressor is to be described as follows:

By means of a drive, not yet to be described here, the piston will be brought into a linear oscillatory movement. This can be performed as a resonance oscillation or as a forced oscillation.

Under the functional aspect, the compressor has three characteristic volumes which will influence the work of the system and will determine the force development:

- the low-pressure working volume 4
- the high-pressure working volume 6
- the auxiliary volume 5 which assists in controlling the piston (optimally by use of a bypass to the left before valve 10, or to the right from valve 12)

When piston 7 moves to the left, the medium in the low-pressure working volume 4 will be displaced. Since, due to the pressure increase, valve 10 will close, the medium will be forced via overflow channel 8 and overflow valve 11 into the enlarging high-pressure working volume 6. Achieved thereby is a precompression of the medium, said precompression being determined approximately by the ratio between the cylinder cross sections of the low-pressure working volume 4 and the cross section of the high-pressure working volume 6.

As soon as the piston has reached its left-hand turning point, the movement is reversed. The medium will now be displaced from the high-pressure working volume 6 and, via outlet valve 12, will enter the outlet. At the same time, the low-pressure working volume 4 will become larger. The pressure drop in the low-pressure working volume 4 and the increase of the pressure in the high-pressure working volume 6 will cause the overflow valve 11 to be closed. At the same time, the medium will be sucked in from the inlet via inlet valve 10.

As soon as the piston has reached its right-hand turning point, the movement is reversed again and the process is repeated.

In the operational mode for the recycling of refrigerant, the above construction has the advantage that a passive pressure compensation will take place between the inlet and the outlet. In this use, the conventionally required bypass of the state of the art can be omitted. By the construction of the double-acting inline free-piston compressor, the medium can directly flow over through the inlet valve 10, the overflow valve 11 and the outlet valve 12. This can occur as a liquid phase and as a gaseous phase.

After pressure compensation, the steam pressure of the refrigerant, which in the present case can be assumed to be 40 bar, will exist in the low-pressure working volume 4 and in the high-pressure working volume 6. Now, the pressure in the auxiliary volume 5 will take a considerable influence on the force/path behavior of the system.

Variant 1: The volume is vented into the ambience. The pressure will thus always be the normal pressure of 1 bar.

Variant 2: The volume is gas-tight and is realized with a constant prepressure $p_0$ as a gas-pressured spring.

Variant 3: The volume is connected to the inlet line so that the prepressure is equal to the working pressure in the refrigeration system.

Variant 4: The volume is connected to the outlet line so that the prepressure in the auxiliary volume is equal to the working pressure in the recycling container.

Figure 3:
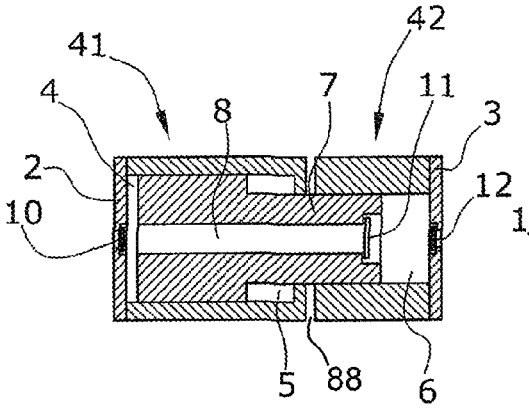
FIG. 3 shows a second embodiment in a first operating state.
Figure 4:
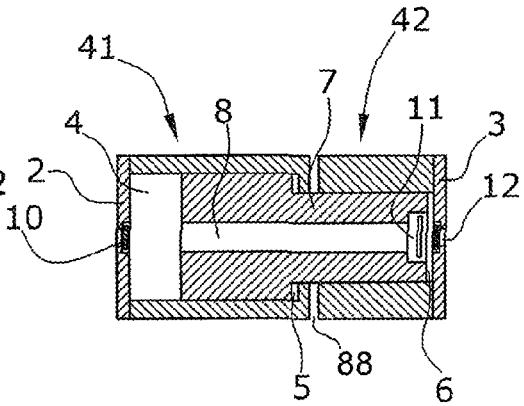
FIG. 4 shows the second embodiment in a second operating state.

A modification of the first embodiment is obtained by opening the cylinder in the middle, so that, as a second embodiment, there is realized a design as depicted in FIGS. 3 and 4 wherein the first cylinder portion 41 is spaced apart from the second cylinder portion 42. Dividing the cylinder into two mutually spaced cylinder portions 41,42 allows for a direct mechanical access to the piston through a space 88 and, thus, also for a drive by use of form-locking engagement.

Figure 5:
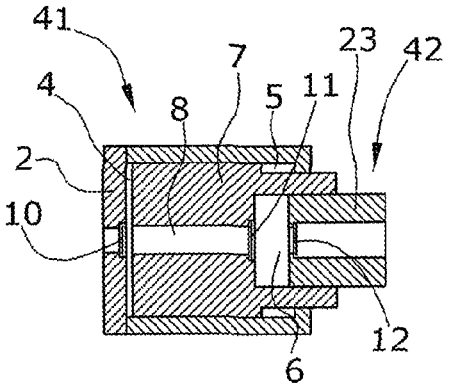
FIG. 5 shows a third embodiment in a first operating state.
Figure 6:
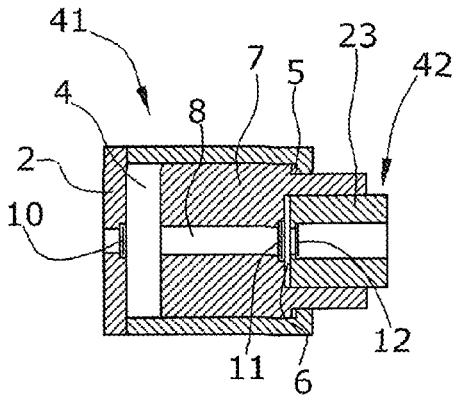
FIG. 6 shows the third embodiment in a second operating state.

A further modification results in the third embodiment according to FIGS. 5 and 6 with an inverse compression chamber. The compressor with inverse compression chamber consists of the piston 25 with the overflow channel 8, of the intermediate valve 11 and of the inverse compression chamber 6. The piston 25 is guided in the cylinder 24 which is terminated by the inlet valve plate 2. In the inlet valve plate 2, the inlet valve 10 is mounted. Inlet valve plate 2, cylinder 24 and piston 25 form the low-pressure working volume 4.

Inserted within the inverse compression chamber 6 is the fixed inverse piston 23 with the outlet channel and the outlet valve 12. The cylinder 24 and the inverse piston 23 are tightly connected to each other via a support rack, not illustrated here, and form the stationary system of the compressor.

An advantage of this arrangement is the direct mechanical access to the piston while maintaining the inline flow of the medium, so that, on the one hand, the driving of the piston can also be performed with forced guidance, e.g. by means of a crank drive, and, on the other hand, the medium can flow directly from the inlet through all valves to the outlet.

Figure 7:
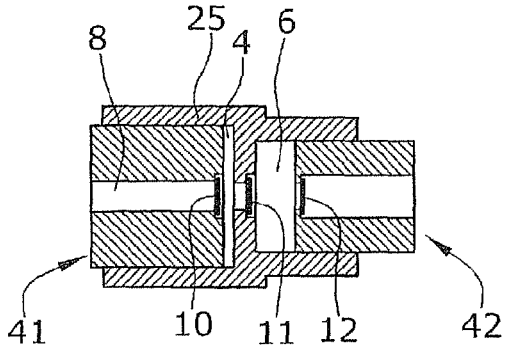
FIG. 7 shows a fourth embodiment in a first operating state.
Figure 8:
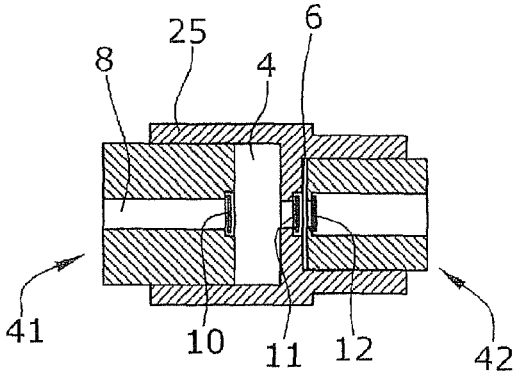
FIG. 8 shows the fourth embodiment in a second operating state.

In the fourth embodiment according to FIGS. 7 and 8, both cylinder portions 41 and 42 are guided as inverse pistons in piston 25.

Figure 9:
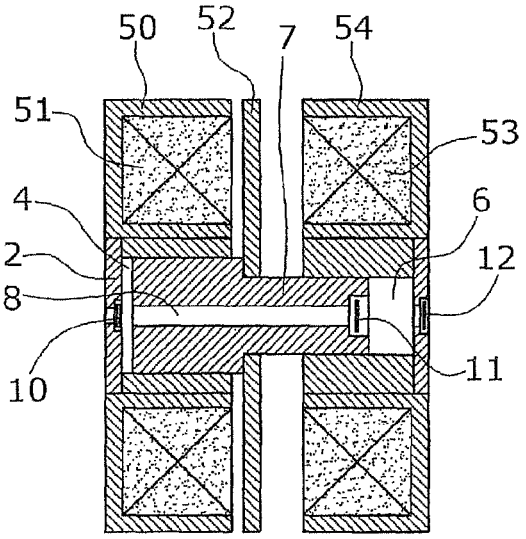
FIG. 9 shows a fifth embodiment.

The fifth embodiment according to FIG. 9 comprises a flat-armature drive for driving the piston. The piston, which itself can be made of a material not relevant for the drive, is mechanically connected to the armature plate 52 made of magnetically soft iron. On both sides, there is arranged a respective pot magnet consisting of the iron core 50 or 54 and of the electric coil 51 or 53. By energizing the coils alternately from both sides, a respective magnetic field is generated between the pot magnet and the armature plate which causes the armature to perform the corresponding movement. For control of the energization, position sensors are required for the piston. In the most simple case, such a sensor can be provided as a slider switch which is operative to switch the energy supply to the other coil when a predetermined end position has been reached.

Other concepts can provide the use of additional electronic elements which will realize the switching not only in dependence on the position but will also include e.g. the speed and the load into the control process. An advantage of this drive resides in that the flat armature has a force/path development which is adaptable to that of the compressor in a favorable manner. Along with a decrease of the air gap between the armature and the magnet, the force will rise in an overproportionate manner, thus allowing particularly the application of the high forces in the piston end positions.

Figure 10:
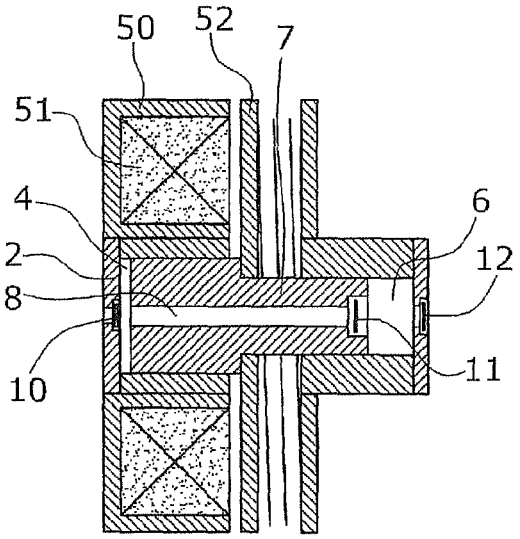
FIG. 10 shows a sixth embodiment.

In the sixth embodiment according to FIG. 10, a magnetic spring drive is used for the piston. The operating principle herein consists in a spring-mass oscillator wherein the piston as the mass is excited to perform an oscillating movement. The work to be delivered by the machine has a damping effect and has to be performed as synchronous excitation by the magnet. The principle is very effective for smaller working capacities. To allow for an oscillation to really occur, the kinetic or potential energy stored in the spring-mass system has to be larger than the work to be delivered.

Figure 11:
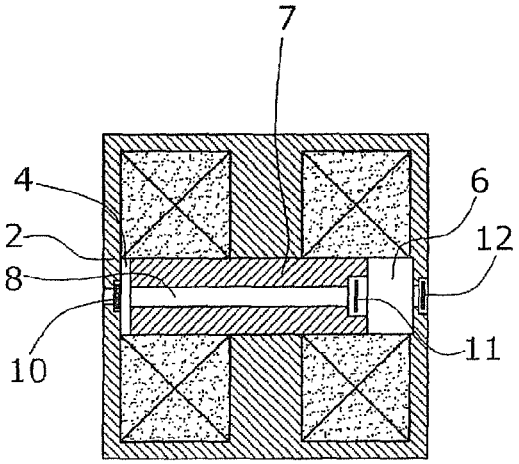
FIG. 11 shows a seventh embodiment.

In the seventh embodiment according to FIG. 11, a plunger-type armature is used as a drive for the piston. The coils will generate, in a manner alternating between the two sides, a magnetic flux in the left and in the right region of the plunger armature. The armature will then each time be pulled into the corresponding end position. Also here, it is imperative to achieve an optimized controlling of the coil so as to avoid an unbraked impacting of the armature. Control of the coils is performed in the same manner as in the flat-armature drive.

Figure 12:
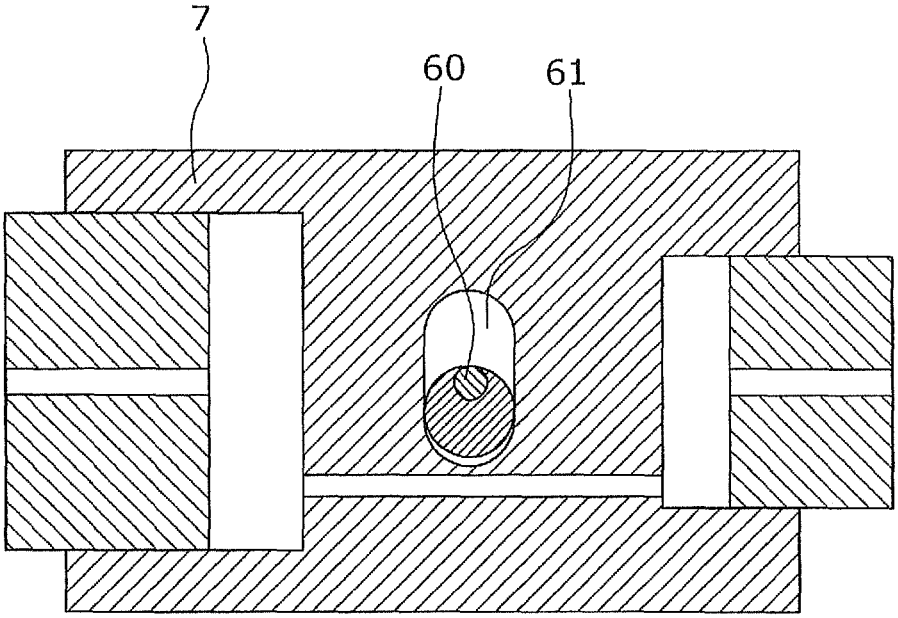
FIG. 12 shows an eighth embodiment.

In the embodiment according to FIG. 12, the piston 7 is driven by a conventional crank drive via an eccentric guide arrangement 61 comprising a shaft 60. Operation of the symmetrically arranged shaft 60 of the rotary drive can be converted into forced oscillation by methods which are also known per se. This approach can be used both for the normal constructional design and for the design with inverse compression chamber. Of advantage herein is the use of normal rotary drives and the forced control of the path.

Figure 13:
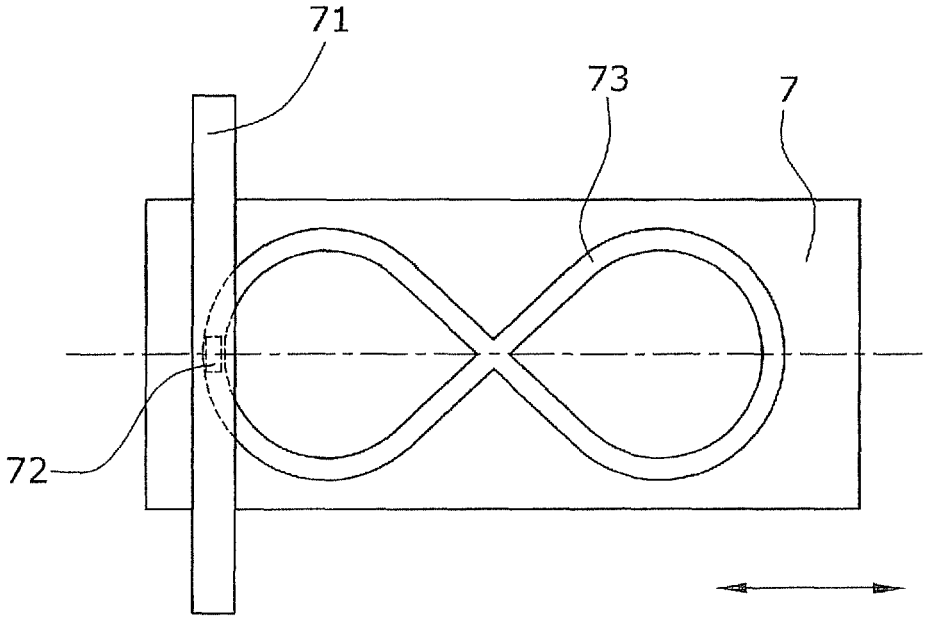
FIG. 13 shows a ninth embodiment.

Alternatively, if a conventional drive is provided, a rotary drive 71 as in FIG. 13, with its rotary axis corresponding to the central longitudinal axis of piston 7, can also serve for engaging, by an interior nose 72, an 8-shaped sliding track 73 arranged on the outer circumferential surface of the piston 7 so that, by rotation of rotary drive 71, piston 7 will be caused to perform an oscillating stroke movement.

The invention claimed is:

1. A double-acting refrigerant compressor comprising a piston freely guided on two cylinder portions of different inner diameters arranged opposite to each other and being immobile relative to each other, said piston guided in said two cylinder portions and driven without a connection to a piston rod, said piston comprising a flow channel extending internally through the piston and each cylinder portion, the flow channel of the piston comprising, respectively, at least one back-check valve, the at least one back-check valve being arranged with a unidirectional flow; and wherein the cylinder portions are spaced from each other in such a manner that a region of the piston is mechanically accessible through a space formed between the spaced cylinder portions from outside the cylinder portions during operation of said double-acting refrigerant compressor;

wherein the piston on an end side thereof comprises a low-pressure compression face and on an opposite side comprises a high-pressure compression face which is smaller than the low-pressure compression face;

wherein the piston comprises, between the low-pressure compression face and the high-pressure compression face, an auxiliary compression surface which, together with the cylinder portion forming the low-pressure working volume, forms an auxiliary volume to generate a restoring force acting against the driving force of the piston, thereby assisting in controlling the piston, said auxiliary volume disposed axially between an inlet valve plate for a low pressure working volume and said space, and said space disposed axially between said auxiliary volume and an outlet valve plate of a high pressure working volume.

2. The double-acting refrigerant compressor according to claim 1, wherein the piston and the cylinder portions are formed with a rotational symmetry, the at least one back-check valve and the flow channel are arranged on a central longitudinal axis of the piston and the cylinder portions.

3. The double-acting refrigerant compressor according to claim 1, wherein, between the piston and each cylinder portion, a respective compressible working volume is formed adjacent to a back-check valve of a respective cylinder portion and to the at least one back-check valve of the piston.

4. The double-acting refrigerant compressor according to claim 1, wherein the at least one back-check valve of the piston is formed in the high-pressure compression face.

5. The double-acting refrigerant compressor according to claim 1, wherein the piston is driven in a contactless manner by two solenoids operating in opposite senses.

6. The double-acting refrigerant compressor according to claim 1, wherein the piston is guided by a crank drive via an eccentric guide arrangement.

7. The double-acting refrigerant compressor according to claim 1, wherein the piston is provided with an "8"-shaped sliding track engaged by a nose of a rotary drive for driving the piston.

8. A double-acting refrigerant compressor for refrigerant recovery comprising:

a refrigerant to be recovered;

a piston of the double-acting refrigerant compressor having a first piston portion of a first outer diameter and a second piston portion of a second outer diameter;

two cylinder portions of said double-acting refrigerant compressor, said two cylinder portions having different cylinder inner diameters including a first cylinder portion having a first cylinder portion inner diameter and a second cylinder portion having a second cylinder portion inner diameter, said two cylinder portions arranged opposite to each other and being immobile relative to each other, said first outer diameter of said first piston portion corresponding to said first cylinder portion inner diameter and said second outer diameter of said second piston portion corresponding to said second cylinder portion, said piston freely guided within said two cylinder portions without a connection to a piston rod;

an inlet valve of said double-acting refrigerant compressor, said inlet valve disposed at an inlet plate of the first cylinder portion of said two cylinder portions;

an outlet valve of said double-acting refrigerant compressor, said outlet valve disposed at an outlet plate of the second cylinder portion of said two cylinder portions, said second cylinder portion inner diameter being smaller than said first cylinder portion inner diameter;

a flow channel of said double-acting refrigerant compressor, said flow channel extending internally through said piston;

a flow channel back-check valve of said double-acting refrigerant compressor, said flow channel back-check valve disposed in said flow channel, said flow channel back-check valve to cause a unidirectional flow direction of said refrigerant to be recovered;

wherein the cylinder portions are spaced from each other in such a manner that a region of the piston is mechanically accessible through a space formed between the spaced cylinder portions from outside the cylinder portions during operation of said double-acting refrigerant compressor;

wherein the piston on an end side thereof comprises a low-pressure compression face and on an opposite side comprises a high-pressure compression face which is smaller than the low-pressure compression face; and wherein the piston comprises, between the low-pressure compression face and the high-pressure compression face, an auxiliary compression surface which, together with the cylinder portion forming the low-pressure working volume, forms an auxiliary volume to generate a restoring force acting against the driving force of the piston, thereby assisting in controlling the piston, said auxiliary volume disposed axially between said inlet valve plate for a low pressure working volume and said space, and said space disposed axially between said auxiliary volume and said outlet valve plate of a high pressure working volume.

9. The double-acting refrigerant compressor of claim 8, wherein a passive pressure compensation takes place between an inlet side and an outlet side of said double-acting refrigerant compressor.

10. The double-acting refrigerant compressor of claim 9, wherein in a refrigerant recycling operation, said double-acting refrigerant compressor removes a refrigerant from a refrigeration system in the absence of a separate bypass line shunting the compressor.

11. A double-acting refrigerant compressor comprising a piston freely guided on two cylinder portions of different inner diameters arranged opposite to each other and being immobile relative to each other, said piston guided in said two cylinder portions and driven without a connection to a piston rod, said piston comprising a flow channel extending internally through the piston and each cylinder portion, the flow channel of the piston comprising, respectively, at least one back-check valve, the at least one back-check valve being arranged with a unidirectional flow; and wherein the cylinder portions are part of a cylinder which is divided into said two cylinder portions being mutually spaced from each other such that the cylinder has an opening in its middle in such a manner that a region of the piston is directly mechanically accessible through a space formed between the spaced cylinder portions from outside the cylinder portions through the opening;

wherein the piston on an end side thereof comprises a low-pressure compression face and on an opposite side comprises a high-pressure compression face which is smaller than the low-pressure compression face; and wherein the piston comprises, between the low-pressure compression face and the high-pressure compression face, an auxiliary compression surface which, together with the cylinder portion forming the low-pressure working volume, forms an auxiliary volume to generate a restoring force acting against the driving force of the piston, thereby assisting in controlling the piston, said auxiliary volume disposed axially between an inlet valve plate for a low pressure working volume and said space, and said space disposed axially between said auxiliary volume and an outlet valve plate of a high pressure working volume.

* * * * *